US006461401B1

(12) United States Patent
Kembaiyan et al.

(10) Patent No.: US 6,461,401 B1
(45) Date of Patent: Oct. 8, 2002

(54) COMPOSITION FOR BINDER MATERIAL PARTICULARLY FOR DRILL BIT BODIES

(75) Inventors: Kumar T. Kembaiyan; Thomas W. Oldham, both of The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/635,746

(22) Filed: Aug. 10, 2000

Related U.S. Application Data

(63) Continuation-in-part of application No. 09/372,896, filed on Aug. 12, 1999, now abandoned.

(51) Int. Cl.[7] ..... C22C 1/04; C22C 1/05

(52) U.S. Cl. ..... 75/236; 75/231; 75/240; 419/5; 419/18

(58) Field of Search ..... 419/5, 18; 75/236, 75/240, 231

(56) References Cited

U.S. PATENT DOCUMENTS

| | | | | | |
|---|---|---|---|---|---|
| 3,778,238 | A | | 12/1973 | Tyler et al. | 29/196.3 |
| 3,790,353 | A | * | 2/1974 | Jackson et al. | 29/182.7 |
| 3,807,965 | A | * | 4/1974 | Tazaki et al. | 29/182.1 |
| 3,880,678 | A | | 4/1975 | Shapiro et al. | 148/11.5 R |
| 3,972,712 | A | | 8/1976 | Renschen | 75/157.5 |
| 3,999,962 | A | | 12/1976 | Drui et al. | 51/307 |
| 4,003,715 | A | | 1/1977 | Cascone | 29/182.3 |
| 4,334,926 | A | * | 6/1982 | Futamura et al. | 75/230 |
| 4,389,074 | A | | 6/1983 | Greenfield | 299/79 |
| 4,391,641 | A | * | 7/1983 | Lloyd | 106/36 |
| 4,630,692 | A | | 12/1986 | Ecer | 175/330 |
| 4,669,522 | A | | 6/1987 | Griffin | 164/97 |
| 4,735,655 | A | * | 4/1988 | Weis et al. | 75/231 |
| 5,000,273 | A | | 3/1991 | Horton et al. | 175/329 |
| 5,303,617 | A | * | 4/1994 | Asada et al. | 75/231 |

FOREIGN PATENT DOCUMENTS

| | | |
|---|---|---|
| DE | 12 58 711 B | 1/1968 |
| GB | 2 153 882 A | 8/1985 |

* cited by examiner

*Primary Examiner*—Daniel J. Jenkins
(74) *Attorney, Agent, or Firm*—Rosenthal & Osha, L.L.P.

(57) ABSTRACT

A composite structural metal use, for example, in drill bit bodies is disclosed. The metal includes powdered tungsten carbide, and binder metal consisting of a composition by weight of manganese in a range of about zero to 25 percent, nickel in a range of about zero to 15 percent, zinc in a range of about 3 to 20 percent, tin in a range of more than 1 percent to about 10 percent, and copper making up about 24 to 96 percent by weight of the composition. In one embodiment, the composition includes about 6 to 7 percent tin therein. In another embodiment, the composition includes about 0–6 percent by weight of cobalt.

19 Claims, 1 Drawing Sheet

COMPOSITION FOR BINDER MATERIAL PARTICULARLY FOR DRILL BIT BODIES

CROSS REFERENCE TO RELATED APPLICATIONS

This is a continuation in part of application Ser. No. 09/372,896 filed on Aug. 12, 1999 now abandoned and assigned to the assignee of the present invention.

BACKGROUND OF THE INVENTION

1. Field of the Invention

The invention relates generally to the field of metal alloys used for various types of housings. More specifically, the invention relates to compositions of binder material used to bind metallic and ceramic powders into solid housings or bodies for such purposes as petroleum wellbore drilling bits.

2. Description of the Related Art

Petroleum wellbore drilling bits include various types that contain natural or synthetic diamonds, polycrystalline diamond compact (PDC) inserts, or combinations of these elements to drill through earth formations. The diamonds and/or PDC inserts are bonded to a bit housing or "body". The bit body is typically formed from powdered tungsten carbide ("matrix") which is bonded into a solid form by fusing a binder alloy with the tungsten carbide. The binder alloy is typically in the form of cubes, but it can also be in powdered form. To form the body, the powdered tungsten carbide is placed in a mold of suitable shape. The binder alloy, if provided in cube form is typically placed on top of the tungsten carbide. The binder alloy and tungsten carbide are then heated in a furnace to a flow or infiltration temperature of the binder alloy so that the binder alloy can bond to the grains of tungsten carbide. Infiltration occurs when the molten binder alloy flows through the spaces between the tungsten carbide grains by means of capillary action. When cooled, the tungsten carbide matrix and the binder alloy form a hard, durable, strong framework to which diamonds and/or PDC inserts are bonded or otherwise attached. Lack of complete infiltration will result in a defective bit body. Typically, natural or synthetic diamonds are inserted into the mold prior to heating the matrix/binder mixture, while PDC inserts can be brazed to the finished bit body.

The chemical compositions of the matrix and binder alloy are selected to optimize a number of different properties of the finished bit body. These properties include transverse rupture strength (TRS), toughness (resistance to impact-type fracture), wear resistance (including resistance to erosion from rapidly flowing drilling fluid and abrasion from rock formations), steel bond strength between the matrix and steel reinforcing elements, and strength of the bond (braze strength) between the finished body material and the diamonds and/or inserts.

One particular property of the binder alloy which is of substantial importance is its or infiltration (flow) temperature, that is, the temperature at which molten binder alloy will flow around all the matrix grains and attach to the matrix grains. The infiltration temperature is particularly important to the manufacture of diamond bits, in which case the diamonds are inserted into the mold prior to heating. The chemical stability of the diamonds is inversely related to the product of the duration of heating of the diamonds and the temperature to which the diamonds are heated as the bit body is formed. Generally speaking, all other properties of the bit body being equal, it is desirable to heat the mixture to the lowest possible temperature for the shortest possible time to minimize thermal degradation of the diamonds. While binder alloys which have low infiltration temperature are known in the art, these binder alloys typically do not provide the finished bit body with acceptable properties.

Many different binder alloys are known in the art. The mixtures most commonly used for commercial purposes, including diamond drill bit making, are described in a publication entitled, *Matrix Powders for Diamond Tools*, Kennametal Inc., Latrobe, Pa. (1989). A more commonly used binder alloy has a composition by weight of about 52 percent copper, 15 percent nickel, 23 percent manganese, and 9 percent zinc. This alloy has a melting temperature of about 1800 degrees F. (968 degrees C.) and an infiltration temperature of about 2050 degrees F. (1162 degrees C.). Other prior art alloys use combinations of copper, nickel and zinc, or copper, nickel and up to about 1 percent tin by weight.

Tin is known in the art to reduce the melting and infiltration temperature of the binder alloy. However, it was believed by those skilled in the art that tin concentrations exceeding about 1 percent by weight in the binder alloy would adversely affect the other properties of the finished bit body material, particularly the toughness, although transverse rupture strength and braze strength can also be adversely affected.

It is desirable to have a binder alloy having as low as possible a infiltration temperature consistent with maintaining the toughness, transverse rupture strength and braze strength of the finished body material.

SUMMARY OF THE INVENTION

One aspect of the invention is a matrix material used, for example, in drill bit bodies. The matrix material includes powdered tungsten carbide, and binder alloy consisting of a composition by weight of manganese in a range of about zero to 25 percent, nickel in a range of about zero to 15 percent, zinc in a range of about 3 to 20 percent, tin in a range of more than 1 percent to about 10 percent, and copper making up about 24 to 96 percent by weight of the alloy composition. In one embodiment, the alloy includes about 6 to 7 percent tin by weight. In a particular embodiment, the alloy includes about 0–6 percent by weight of cobalt.

Another aspect of the invention is a method for forming drill bit bodies. The method includes inserting into a mold a mixture including powdered tungsten carbide and a binder alloy consisting of a composition, by weight, of manganese in a range of about zero to 25 percent, nickel in a range of about zero to 15 percent, zinc in a range of about 3 to 20 percent, tin in a range of more than 1 percent to about 10 percent, and copper making up about 24 to 96 percent by weight of the alloy. The matrix material is heated to the infiltration temperature of the binder alloy to infiltrate through the powdered tungsten carbide. In one embodiment, the binder alloy includes about 6 to 7 percent tin by weight. In a particular embodiment, the alloy includes about 0–6 percent by weight of cobalt.

DESCRIPTION OF THE PREFERRED EMBODIMENT

Figure 1:
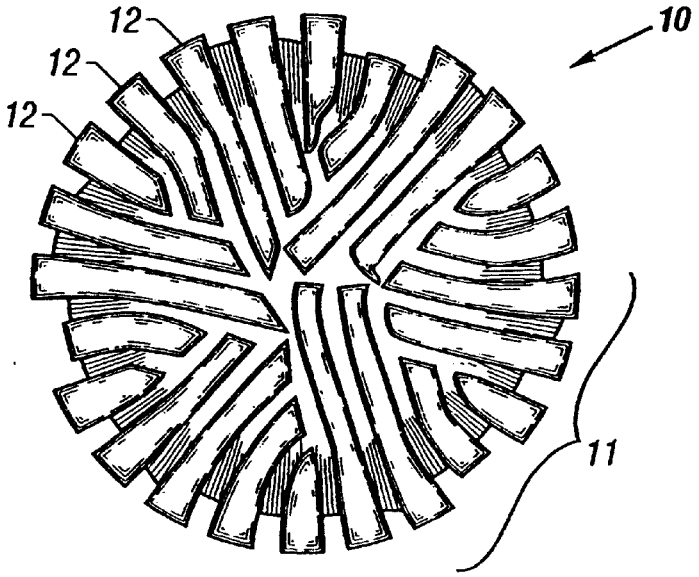
FIG. 1 shows an end view of a drill bit formed from a body material having binder according to the invention.

FIG. 1 shows an end view of a so-called "impregnated diamond" drill bit 10. The drill bit 10 is formed into a generally cylindrically shaped body 11 which includes circumferentially spaced apart blades 12. The blades 12 include natural or synthetic diamonds (not shown in FIG. 1) embedded in the outer surfaces thereof. As is well known in the art, the drill bit 10 is coupled to a rotary power source such as a drill pipe (not shown) or an hydraulic motor (not shown) to rotate the drill bit 10 as it is axially pressed against earth formations to drill the earth formations. Such diamonds are one classification of so-called "cutters" which deform or scrape the earth formations to drill them. Another well known form of such cutters is polycrystalline diamond compact (PDC) inserts which are typically brazed to the body 11 after it is formed.

Figure 2:
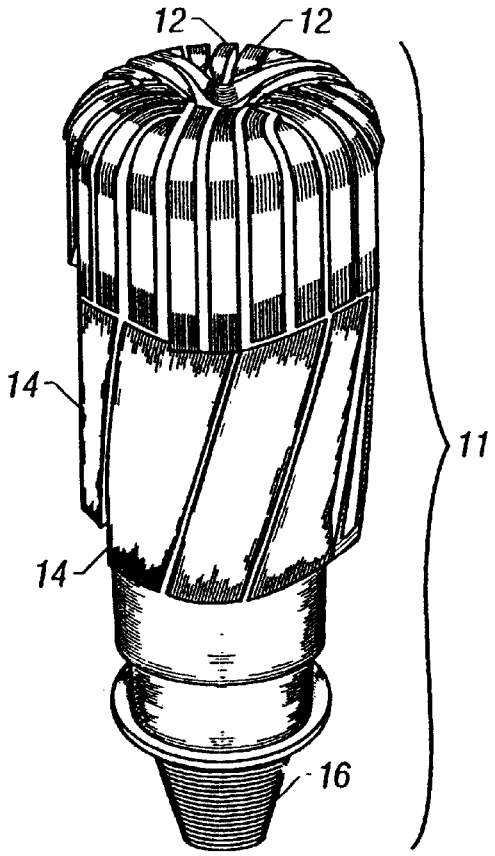
FIG. 2 shows a side view of the drill bit shown in FIG. 1.

A side view of the drill bit 10 is shown in FIG. 2. The drill bit 10 can include, at the end of the body 11 opposite to the end shown in FIG. 1, a threaded coupling 16 for attachment to the drill pipe or hydraulic motor, and may include gauge pads 14 or the like to maintain the diameter of the hole drilled by the drill bit 10.

The invention concerns the composition of the material from which the body 11 is formed, and more specifically, concerns the composition of a binder alloy used to bond together grains of powdered metal to form the body 11.

As described in the Background section herein, the body 11 is typically formed by infiltrating powdered tungsten carbide with a binder alloy. The tungsten carbide and binder alloy are placed in a mold (not shown) of suitable shape, wherein the part of the mold having forms for the blades 12 will have diamonds mixed with the powdered tungsten carbide to form one of the so-called diamond impregnated drill bits. The mold having diamonds, carbide and binder alloy therein is then heated in a furnace to the flow or infiltration temperature of the binder alloy for a predetermined time to enable the molten binder alloy to flow around the grains of the tungsten carbide.

It has been determined that binder alloy compositions to be described below provide the finished body 11 with suitable combinations of transverse rupture strength (TRS), toughness, braze strength and wear resistance. A preferred binder alloy composition includes by weight about 57 percent copper, 10 percent nickel, 23 percent manganese, 4 percent zinc and 6 percent tin. This composition for the binder alloy has a melting temperature of about 1635 degrees F. (876 degrees C.) and a flow or infiltration temperature of about 1850 degrees F. (996 degrees C.).

Other compositions of binder alloy according to the invention can have, by weight, nickel in the range of about zero to 15 percent; manganese in the range of about zero to 25 percent; zinc in the range of about 3 to 20 percent, and tin more than 1 percent up to about 10 percent. The copper makes up about 24 to 96 percent by weight of any such composition of binder alloy, these amounts representing substantially the remainder of the composition. The preferred amount of tin in the binder alloy is about 6 to 7 percent. Although nickel and manganese can be excluded from the binder alloy entirely, is should be noted that nickel helps the mixture "wet" the tungsten carbide grains, and increases the strength of the finished bit body. Manganese, when included in the recommended weight fraction range of the binder alloy composition, also helps lower the melting temperature of the binder alloy. While it is known that tin will lower the melting and infiltration temperature of the binder alloy, too much tin in the binder alloy will result in the finished body 11 having too low a toughness, that is, it will be brittle. Including tin in the recommended weight fraction in the binder alloy composition results in a substantial decrease in the infiltration temperature of the binder alloy, as well as improved wettability of the binder alloy, particularly of the diamonds. The other properties of the finished bit body material will be maintained with commercially acceptable limits, however.

It has been determined that a small amount of cobalt added to the mixture has the effect of improving the wetting ability of the mixture both to the tungsten carbide and to the diamonds which are bonded to the bit body. Adding cobalt to the mixture in substitution of some of the copper in a range of about 0 to 6 percent by weight provides the mixture with much of the benefit of the reduced infiltration temperature of the mixtures not having cobalt therein, while improving the wettability and bonding of the mixture as an infiltrant. More preferably, the cobalt is added in substitution of the copper to about 2 to 3 percent by weight of the mixture.

While the example embodiment described herein is directed to an impregnated diamond bit, it should be clearly understood that PDC insert bits can have the bodies thereof formed from a composite material having substantially the same composition as described herein for diamond impregnated bits. It has been determined that the material described herein is entirely suitable for PDC insert bit bodies, and has the advantage of being formed at a lower temperature than materials of the prior art. Lowering the temperature can reduce energy costs of manufacture and can reduce deterioration of insulation on the furnace walls, and the furnace heating elements. Lowering the infiltration temperature also provide the advantage of minimizing the degradation of drill bit components such as reinforcement steel blanks and the matrix powders which can oxidize at higher furnace temperatures, thereby softening and losing strength.

Those skilled in the art will appreciate that other embodiments of the invention can be devised which do not depart from the spirit of the invention as disclosed herein. Accordingly, the scope of the invention should be limited only by the attached claims.

What is claimed is:

1. A composite structural metal, comprising:

powdered tungsten carbide; and binder alloy comprising a composition by weight of manganese in a range of about zero to 25 percent, nickel in a range of about zero to 15 percent, zinc in a range of about 3 to 20 percent, tin in a range of about 6 to 7 percent, and copper in a range of about 24 to 96 percent by weight of said alloy composition, said binder alloy infiltrated through said powdered tungsten carbide.

2. The composite structural metal as defined in claim 1 wherein said copper comprises about 57 percent of said alloy composition, said manganese comprises about 23 percent of said alloy composition, said nickel comprises about 10 percent of said alloy composition, said zinc comprises about 4 percent of said alloy composition, and said tin comprises about 6 percent of said alloy composition.

3. The composite structural metal as defined in claim 1 further comprising about 0 to 6 percent by weight of cobalt in the alloy composition.

4. The composite structural metal as defined in claim 1 further comprising about 2 to 3 percent by weight of cobalt in the alloy composition.

5. The composite structural metal as defined in claim 1 wherein the copper forms substantially the remainder of the alloy composition.

6. A drill bit, comprising:

a composite structural body comprising powdered tungsten carbide and binder alloy, said binder alloy comprising a composition by weight of manganese in a range of about zero to 25 percent, nickel in a range of about zero to 15 percent, zinc in a range of about 3 to 20 percent, tin in a range of about 6 to 7 percent, and copper making up about 24 to 96 percent by weight of said composition, said binder alloy infiltrated through said tungsten carbide; and cutters bonded to said composite structural body.

7. The drill bit as defined in claim 6 wherein said copper comprises about 57 percent of said alloy composition, said manganese comprises about 23 percent of said alloy composition, said nickel comprises about 10 percent of said alloy composition, said zinc comprises about 4 percent of said alloy composition, and said tin comprises about 6 percent of said alloy composition.

8. The drill bit as defined in claim 6 wherein said cutters comprise polycrystalline diamond compact inserts bonded to said composite structural body.

9. The drill bit as defined in claim 6 wherein said cutters comprise diamonds formed into blades in said composite structural metal body.

10. The drill bit as defined in claim 6 further comprising about 0 to 6 percent by weight of cobalt in the alloy composition.

11. The drill bit as defined in claim 6 further comprising about 2 to 3 percent by weight of cobalt in the alloy composition.

12. The drill bit as defined in claim 6 wherein the copper forms substantially the remainder of the alloy composition.

13. A method for forming a drill bit body, comprising:

inserting into a mold a mixture comprising powdered tungsten carbide and a binder alloy consisting of a composition by weight of manganese in a range of about zero to 25 percent, nickel in a range of about zero to 15 percent, zinc in a range of about 3 to 20 percent, tin in a range of about 6 to 7 percent, and copper making up about 24 to 96 percent by weight of the alloy composition; and heating the mixture to the infiltration temperature of the binder alloy to bind the alloy to the powdered tungsten carbide.

14. The method as defined in claim 12 wherein said copper comprises about 57 percent of said composition, said manganese comprises about 23 percent of said composition, said nickel comprises about 10 percent of said composition, said zinc comprises about 4 percent of said composition, and said tin comprises about 6 percent of said composition.

15. The method as defined in claim 12 further comprising inserting diamonds into said mold prior to said heating, so that an impregnated diamond drill bit is formed thereby.

16. The method as defined in claim 12 further comprising bonding polycrystalline diamond compact inserts to said drill bit body to form a drill bit thereby.

17. The method as defined in claim 12 further comprising adding about 0 to 6 percent by weight of cobalt to said alloy composition prior to said heating.

18. The method as defined in claim 12 further comprising adding about 2 to 3 percent by weight of cobalt to said alloy composition prior to said heating.

19. The method as defined in claim 12 wherein the copper forms substantially the remainder of the alloy composition.

* * * * *